US008075957B2

(12) United States Patent
Kim et al.

(10) Patent No.: US 8,075,957 B2
(45) Date of Patent: Dec. 13, 2011

(54) METHOD OF PREVENTING CORROSION DEGRADATION USING NI OR NI-ALLOY PLATING

(75) Inventors: Joung Soo Kim, Daejeon (KR); Dong Jin Kim, Daejeon (KR); Myong Jin Kim, Daejeon (KR); Hong Pyo Kim, Daejeon (KR)

(73) Assignees: Korea Atomic Energy Research Institute, Daejeon (KR); Korea Hydro and Nuclear Power Co., Ltd., Seoul (KR)

( * ) Notice: Subject to any disclaimer, the term of this patent is extended or adjusted under 35 U.S.C. 154(b) by 771 days.

(21) Appl. No.: 12/250,927

(22) Filed: Oct. 14, 2008

(65) Prior Publication Data

US 2009/0252883 A1 Oct. 8, 2009

(30) Foreign Application Priority Data

Apr. 8, 2008 (KR) ..... 10-2008-0032797

(51) Int. Cl.
*B05D 1/36* (2006.01)

(52) U.S. Cl. ..... 427/405; 427/239; 427/327; 427/328; 427/331; 427/347

(58) Field of Classification Search ..... 427/430.1, 427/327
See application file for complete search history.

(56) References Cited

U.S. PATENT DOCUMENTS

| | | | | |
|---|---|---|---|---|
| 4,134,287 | A * | 1/1979 | Le Huede et al. | 72/283 |
| 4,624,750 | A * | 11/1986 | Malagola et al. | 205/131 |
| 5,660,705 | A * | 8/1997 | Michaut | 205/115 |

FOREIGN PATENT DOCUMENTS

| | | |
|---|---|---|
| KR | 1019810000034 | 2/1981 |
| KR | 1020020075525 | 10/2002 |
| KR | 1020030077188 | 10/2003 |
| KR | 1020050028449 | 3/2005 |
| KR | 100609590 | 7/2006 |
| WO | 2007086666 | 8/2007 |

OTHER PUBLICATIONS

J. Benson, Steam Generator Progress Report, Rev. 14, EPRI Report TE-106365-R14 (Palo Alto, CA EPRI, 1999).
Larue, F., et al. Nickel Plating S.G. Tubing Repair; Proc. of the 1991 JAIF International Conference on Water Chemistry in Nuclear Power Plants, 1989, pp. 163-167.
Michaut, B., et al.; Nickel Electroplating as a Remedy to Steam Generator Tubing PWSCC; Proc of the 6th International Symposium on Environmental Degradation of Materials in Nuclear Power Systems-Water Reactors, 1993; pp. 713-719.
Stubbe, J., et al.; Repairing Cracked Tubes with Nickel Plating, Nuclear Engineering International, vol. 34; 1989; pp. 31-33.
Gonzalez, F., et al.; Electrodeposited Nanostructured Nickel for In-Situ Nuclear Steam Generator Repair; Materials Science Forum, vol. 225-227; 1996; pp. 831-836.
ASTM G3; Standard Practice for Conventions Applicable to Electrochemical Measurements in Corrosion Testing; 2002; pp. 1-10.
Joung-Soo Kim, et al.; Prevention of SCC in the Expansion Transition Region of Steam Generator Tubing of PWRs by Ni-plating; IAEA-CN-155/035; Second International Symposium on Nuclear Power Plant Life Management; Shanghai, China; Oct. 15-18, 2007.

* cited by examiner

*Primary Examiner* — David Turocy
(74) *Attorney, Agent, or Firm* — H.C. Park & Associates, PLC

(57) ABSTRACT

Disclosed herein is a method of preventing corrosion degradation in a defective region including an expansion transition region and/or an expansion region of a heat transfer tube of a steam generator in a nuclear power plant by using nickel (Ni) plating or nickel (Ni) alloy plating. The method can prevent various types of corrosion damage, such as pitting corrosion, abrasion, stress corrosion cracking, lead-induced stress corrosion cracking and the like, occurring during the operation of the steam generator, and particularly, pitting corrosion or primary and secondary stress corrosion cracking, so that the life span of the steam generator is increased, maintenance costs are reduced, and the operation rate of a nuclear power plant is increased, with the result that the unit cost of the production of electric power can be decreased, thereby improving economic efficiency. Further, the method can be usefully used to prevent the corrosion damage of parts and equipment of nuclear, hydroelectric or thermoelectric power plants or of petrochemical plants, and that of industrial and machine parts and equipment, and parts and equipment in a defense industry.

9 Claims, 6 Drawing Sheets

METHOD OF PREVENTING CORROSION DEGRADATION USING NI OR NI-ALLOY PLATING

BACKGROUND OF THE INVENTION

1. Field of the Invention

The present invention relates to a method of preventing corrosion degradation using Ni or Ni-alloy plating.

2. Description of the Related Art

In recent years, a commercial nuclear reactor that has been operated all over the world includes a pressurized water reactor and a boiling water reactor developed in the U.S.A, a high-temperature gas cooling reactor developed in the U.K. and a pressurized heavy water reactor developed in Canada. All nuclear power plants in Korea, except Wolseong nuclear power plant, are provided with pressurized water reactors. The pressurized water reactor (PWR) uses lowly-concentrated uranium containing approximately 2~5% of uranium 235 as fuel and uses water (light water) as a coolant or moderator. The water is made not to boil inside a nuclear reactor by pressurizing a primary cooling system at a pressure of approximately 150 atms. Water heated to high temperature is sent to a steam generator and is changed into steam through heat exchange with secondary side water. The heat-exchanged primary side water is returned to the nuclear reactor and is heated, and then the heated water is sent to the steam generator again. This process is repeatedly performed.

One of the accidents often occurring in the pressurized water nuclear power plant is leakage in a heat transfer tube of a steam generator. It is determined that the leakage in the heat transfer tube of the steam generator occurs due to two or more causes. One of the causes of the leakage is that the thickness of the heat transfer tube is decreased. As the result of examining eddy currents of the heat transfer tube, it was found that the heat transfer tube becomes thinner due to friction between the heat transfer tube and a tube support plate or an AVB (anti-vibration bar), wherein the friction results from the vibration of the heat transfer tube due to the flow of a fluid. Currently, since this tube wear phenomenon occurring due to the vibration of the tube caused by the flow of fluid, unlike the degradation of the tube due to corrosion, can be improved by upgrading the design of the steam generator. Due to the upgrade of the design of the steam generator, the vibration of the tube caused by the flow of fluid is remarkably reduced, but is still one main cause for the degradation to the heat transfer tube.

As another cause for the leakage in the heat transfer tube, various types of corrosion such as stress corrosion cracking, pitting corrosion, etc. occur in a top of a tubesheet, that is, including an expansion transition region of the heat transfer tube (the top of the tubesheet and the expansion transition region are substantially consistent with each other) due to the sludge piled up on the top of the tubesheet and high residual stress around the expansion transition region of the tube. The sludge made of various metal oxides including iron oxides, etc. and metals including copper, etc piled up on the top of the tubesheet changes chemical and thermal environments between sludge and the heat transfer tube into an environment aggravating the corrosion and results in generating tensile stress which may cause the stress corrosion cracking in the heat transfer tube by partially transforming the heat transfer tube due to tenting occurring due to corrosion oxidation of the tubesheet between the heat transfer tube and the tubesheet made of carbon steel. Therefore, in order to alleviate the corrosion degradation in the expansion transition region of the heat transfer tube (the top of the tubesheet), it is very important to remove the sludge during the operation of a nuclear power plant. The method of removing the sludge is called a sludge lance absorption method (Korean Unexamined Patent Publication No. 1981-0000034). However, even in the case where the sludge is not almost accumulated in the top of the tubesheet in the nuclear power plant in operation, the stress corrosion cracking occurs. The reason for this is that stress applied to the expansion transition region of the heat transfer tube during the operation of the nuclear power plant, or the corrosive environment of primary cooling water and secondary cooling water, and metallurgical stress corrosion cracking sensitivity of the heat transfer tube are compositely acted.

Therefore, a material of the heat transfer tube is a major factor in the cracking of the heat transfer tube. Currently, Inconel 600 alloy mainly containing nickel is being used as the material of the heat transfer tube of a steam generator in the nuclear power plant. The Inconel 600 alloy is excellent in mechanical properties and corrosion resistance, and thus is used as the material of the heat transfer tube of the steam generator in the pressurized water nuclear power plant, but the heat transfer tube is vulnerable to the stress corrosion cracking under operating conditions at primary and secondary sides of the steam generator, and thus intergranular corrosion and the stress corrosion cracking frequently occur under the operating condition. In particular, the intergranula corrosion and the stress corrosion cracking more frequently occur in the material of the heat transfer tube at the secondary side.

The intergranular corrosion is described as follows. When austenitic Ni-base alloys are heated to 500~800° C., carbides ($Cr_{23}C_6$) are formed on the grain boundary thereof, and the amount of chromium (Cr) existing at the portion adjacent to the grain boundary is reduced, thereby forming a Cr depletion region. A process of making this state is referred to as sensitization treatment. The sensitization-treated alloys are immersed into a corrosive solution, the Cr depletion region is remarkably corroded, resulting in disintegration of grains. This phenomenon is referred to as intergranular corrosion.

The stress corrosion cracking is a phenomenon that a metallic material under the tensile stress becomes brittle and easily broken under a specific combination of the material and the corrosion environment. The stress corrosion cracking occurs only when three conditions such as the material, the environment, and the stress satisfy the specific condition. In general, a material having excellent corrosion resistance has a passivation layer formed on the surface thereof. However, the passivation layer is partially broken due to external causes, and thus becomes a starting point for the pitting or the stress corrosion cracking. Stress concentration is partially increased, and the corrosive solution contributes to the propagation of the stress corrosion cracking, thereby accelerating the cracking.

The intergranular corrosion or the stress corrosion cracking of the heat transfer tube of the steam generator causes a leakage accident of the primary cooling water and unscheduled trip of the plant, and becomes a direct cause for repair of the broken heat transfer tube and finally the replacement of the steam generator itself, thereby incurring an enormous economic loss.

Accordingly, in order to prevent an accident and a loss due to the corrosion and the stress corrosion cracking of the heat transfer tube of the steam generator in the nuclear power plant, or in order to prevent deterioration occurring in various materials of parts through which cooling water passes so as to reduce the amount of the sludge primarily causing the corrosion degradation of the heat transfer tube of the steam generator, researches on the development of an alloy capable of substitution, proper chemical water treatment (secondary water treatment) and the improvement of a processing operation of the steam generator are required.

Conventionally, Korean Patent Registration No. 415265 discloses a method of suppressing the stress corrosion cracking at the secondary side of the heat transfer tube of the steam generator in the nuclear power plant, in which a compound selected from the group consisting of cerium boride, lanthanum boride, and a mixture thereof is supplied to secondary cooling water, and by which the resistance to the stress corrosion cracking of the heat transfer tube can be improved by three times or more, and by two times or more compared to a conventional corrosion inhibitor.

Further, Korean Patent Registration No. 609590 discloses an inhibitor containing nickel boride and a method of suppressing the corrosion and the stress corrosion cracking at a secondary side of the heat transfer tube of the steam generator in the nuclear power plant, using the inhibitor. In this method, nickel boride suppresses the stress corrosion cracking of a specimen simulating the heat transfer tube of the steam generator in the nuclear power plant and increases the corrosion resistance by reducing corrosion current density and the thickness of an oxide film. However, the expansion transition region in the top of the tubesheet of the heat transfer tube is still degraded and an effort to prevent the corrosion degradation is continuously exerted.

Meanwhile, the degraded heat transfer tube is discarded by plugging the tube or is reused by sleeving the tube. As a repairing technology for sleeving the tube, a technology of plating the inner portion of the tube, adjacent to a degraded portion, with Ni or Ni-alloy has been developed ((a) Larue, F., "Nickel plating S.G. tubing repair", Proc. of the 1991 JAIF international conference on water chemistry in nuclear power plants, 1989 pp. 163-167; (b) Michaut, B., "Nickel electroplating as a remedy to steam generator tubing PWSCC", Proc. of the $6^{th}$ international symposium on environmental degradation of materials in nuclear power systems-water reactors, 1993 pp. 713-719; (c) Stubbe, J. et al., "Repairing cracked tubes with Nickel plating", Nuclear Engineering International, Vol. 34 (1989) pp. 31-33; (d) Gonzalez, F., Brennenstuhl, A. M., Palumbo, G., Erb, U., and Lichtenberger, P. C., "Electrodeposited Nanostructured Nickel for In-Situ Nuclear Steam Generator Repair", Materials Science Forum, Vol. 225-227 (1996) pp. 831-836). Therefore, it has been found that the Ni plated tube or Ni-alloy plated tube has excellent corrosion resistance to the corrosion degradation and to the pitting, the stress corrosion cracking (SCC), etc.

More specifically, in the Ni plating, structural integrity cannot be granted to the degraded heat transfer tube in mechanical properties, but it is possible to prevent leakage or the crack from growing by plating an adjacent part including a defective portion in the Ni-alloy plating, since excellent mechanical properties can be bestowed to the degraded heat transfer tube, it is possible to prevent leakage in the degraded heat transfer tube and acquire the structural integrity, thereby performing the sleeved tube having a circumferential cracking defect as a heat transfer tube.

SUMMARY OF THE INVENTION

Therefore, while the inventors researched into a method for preventing degradation in the expansion transition region in the top of the tubesheet of the heat transfer tube, they have found that when the expansion transition region and expansion region are coated with nickel at the time of manufacturing the steam generator by inserting the heat transfer tube into the tubesheet and expanding the heat transfer tube after plating inner and outer surfaces of the heat transfer tube from both ends to the upper portion of the expansion transition region, it is possible to prevent various corrosion degradation occurring in the heat transfer tube of the steam generator during the operation of the nuclear power plant, thereby completing the present invention.

Accordingly, the present invention has been made keeping in mind the above problems occurring in the prior art, and an object of the present invention is to provide a method of preventing corrosion degradation using nickel (Ni) plating or nickel (Ni) alloy plating.

In order to accomplish the above object, the present invention provides a method of preventing the corrosion degradation including an expansion transition region and/or an expansion region of a heat transfer tube of a steam generator in a nuclear power plant by plating the heat transfer tube with nickel (Ni) or nickel (Ni) alloy.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
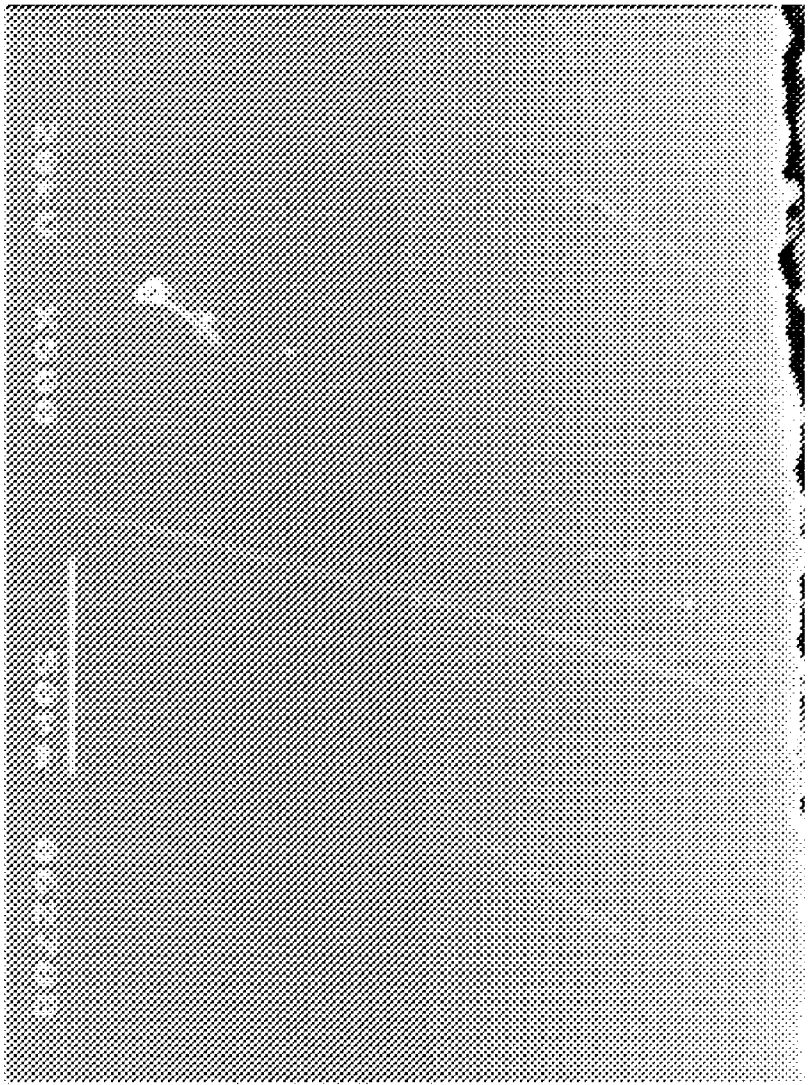
FIG. 1 is a scanning electron micrograph showing a nickel-plated heat transfer tube of the steam generator expanded at a pressure of 32,000 psi according to an embodiment of the present invention.

Hereinafter, preferred embodiments of the present invention will be described in detail with reference to the attached drawings.

The present invention provides a method of preventing the corrosion degradation in the defective region of a heat transfer tube of a steam generator in a nuclear power plant by planting the heat transfer tube with nickel (Ni) or nickel (Ni) alloy.

In the method of preventing the corrosion degradation in a heat transfer tube of a steam generator according to the present invention, the defective region includes an expansion transition region and/or an expansion region of the heat transfer tube.

In the method of preventing the corrosion degradation in a heat transfer tube of a steam generator according to the present invention, the nickel plating or the nickel alloy plating may be partially or entirely conducted on the inner surface and outer surface of the heat transfer tube. Preferably, the nickel plating or the nickel alloy plating may be conducted from both ends of the heat transfer tube to the upper portion of the expansion transition region of the heat transfer tube, and the upper portion of the expansion transition region thereof is determined in consideration of the height of deposited sludge. In this case, examples of the nickel alloy may include, but are not limited to, Ni—P, Ni—Fe—P, Ni—P—B, and the like. As the plating method of the present invention, plating methods commonly used in the art may be used. For example, an electrolytic plating method or an electroless plating method may be used as the plating method.

In this case, it is preferred that the thickness of the nickel plated layer or nickel alloy plated layer be in the range of 1 to 1000 μm. When the thickness thereof is less than 1 μm, there is a problem in that the nickel plated layer or nickel alloy plated layer cannot adapt to the corrosion environment formed in the sludge when the steam generator is used for a long time. In contrast, when the thickness thereof is more than 1000 μm, there are problems in that the flow of primary cooling water is inhibited, and in that the plastic deformation of the plated layer is excessively made at the time of expanding the heat transfer tube, and thus the corrosion resistance and mechanical properties of the plated layer are deteriorated. Further, due to the increase in the outer diameter of the heat transfer tube, a process of designing and manufacturing a steam generator may be greatly influenced. Moreover, a nickel (Ni) strike layer may be first formed before the nickel plating in order to increase the adhesion force between a matrix and a plated layer.

The tubes plated with nickel or nickel alloy on the inner and outer surface of the heat transfer tube are inserted into the holes in the tubesheet, and then expanded to manufacture a steam generator. In this case, the expansion of the tubes may be performed by using a mechanical expansion method, an explosion expansion method or a hydraulic expansion method.

It was found that the heat transfer tube of the steam generator manufactured in this way is advantages in that the nickel plated layer is not separated or peeled off from the matrix even when it is expanded (refer to FIGS. 1 and 2), and in that stress corrosion cracking or pitting corrosion does not occur even under environmental conditions in which an alkali or acid solution causing stress corrosion cracking and pitting corrosion is used and corrosion potential is applied (refer to FIGS. 3 to 6).

Therefore, the heat transfer tube of the steam generator according to the present invention can prevent various types of corrosion damage, such as pitting corrosion, abrasion, stress corrosion cracking, lead-induced stress corrosion cracking and the like, occurring during the operation of the steam generator, and particularly, pitting corrosion or primary and secondary stress corrosion cracking, so that the life span of the steam generator is increased, maintenance costs are reduced, and the operation rate of a nuclear power plant is increased, with the result that the unit cost of the production of electric power can be decreased, thereby improving economic efficiency. Further, the heat transfer tube of the steam generator according to the present invention can prevent the occurrence of through-wall defects due to the corrosion damages, so that it can prevent primary cooling water contaminated by radioactivity from flowing into a secondary cooling water, with the result that a nuclear power plant can be safely operated, thereby enabling the national consciousness about nuclear power plants to remain friendly.

Further, the method of preventing the corrosion degradation in the heat transfer tube of the steam generator according to the present invention can be applied to primary and secondary welded regions of the nuclear power plant, such as welded regions of CRDM nozzles, welded regions of pipes, welded regions of different kinds of metals, welded regions of parts in a pressure container, and the like, in addition to the expansion transition region and/or expansion region of the heat transfer tube.

Further, the method of preventing the corrosion degradation in the heat transfer tube of the steam generator according to the present invention can be applied to prevent corrosion damage of parts and equipment in a nuclear power plant, parts and equipment in a hydroelectric or thermoelectric power plant, parts and equipment in a petrochemical plant, industrial parts and equipment, machine parts and equipment, and parts and equipment in the defense industry.

Hereinafter, the present invention will be described in more detail with reference to the following Examples. However, the following examples are set forth to illustrate the present invention, and the spirit and scope of the present invention are not limited thereto.

Example 1

Manufacture of Nickel-Plated Heat Transfer Tube of Steam Generator

A nickel strike layer having a thickness of about 5 μm was formed on the inner and outer surfaces of Alloy 600, which is a commercial heat transfer tube material and comprises 0.025 wt % of carbon (C), 0.05 wt % of silicon (Si), 0.22 wt % of manganese (Mn), 0.07 wt % of phosphorus (P), 15.67 wt % of chromium (Cr), 75.21 wt % of nickel (Ni), 8.24 wt % of iron (Fe), 0.005 wt % of cobalt (Co), 0.39 wt % of titanium (Ti), 0.011 wt % of copper (Cu), 0.15 wt % of aluminum (Al), 0.0014 wt % of boron (B), 0.001 wt % of sulfur (S) and 0.0103 wt % of nitrogen (N), by electroplating in a nickel strike solution thereon to increase the adhesion force between a matrix and a plated layer, and then a nickel plated layer having a thickness of about 50~80 μm was formed on the nickel strike layer to manufacture a heat transfer tube, the inner and outer surfaces of which is plated with nickel.

Experimental Example 1

Analysis of Surface of Nickel-Plated Layer after Expanding Heat Transfer Tube Specimens of the nickel-plated heat transfer tube manufactured in Example 1 were expanded at pressures of 32,000 and 35,000 psi using a hydraulic expansion method similar to a process of expanding a heat transfer tube used during the initial manufacturing of a commercial steam generator at a steam generator manufacturing company. As the tubesheet material used at the time of expanding the nickel-plated heat transfer tube, carbon steel SA 508, which is similar to the material used to manufacture a steam generator in a nuclear power plant, was used. The average expansion rates of the nickel-plated heat transfer tube at pressures of 32,000 and 35,000 psi were 1.23% and 1.67%, respectively.

Figure 2:
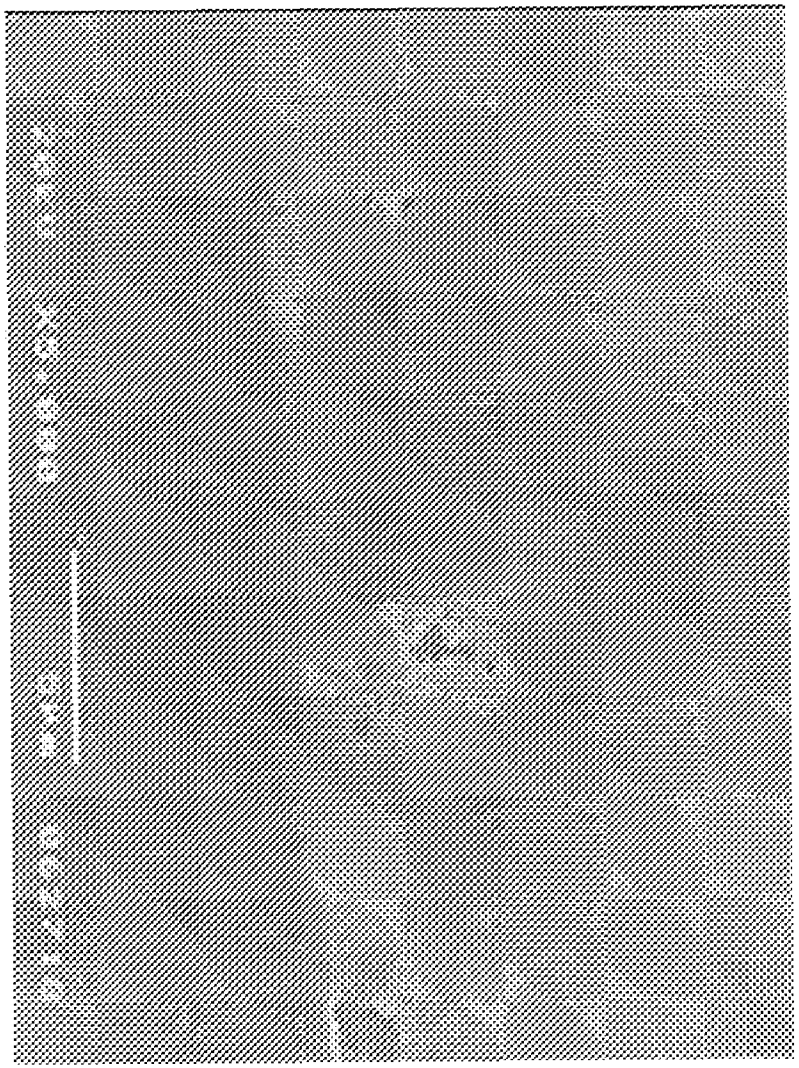
FIG. 2 is a scanning electron micrograph showing a nickel-plated heat transfer tube of the steam generator expanded at a pressure of 35,000 psi according to an embodiment of the present invention.

After the expansion of the nickel-plated heat transfer tube, its section was observed using a scanning electron microscope, and the results thereof are shown in FIGS. 1 and 2.

FIG. 1 shows a section of the nickel-plated heat transfer tube expanded at a pressure of 32,000 psi, and FIG. 2 shows a section of the nickel-plated heat transfer tube expanded at a pressure of 35,000 psi.

From FIGS. 1 and 2, it was found that all of the nickel-plated layer and the intermediate layer (nickel strike layer) between the nickel-plated layer and the matrix were not particularly damaged, and that the intermediate layer was not separated.

Experimental Example 2

Stress Corrosion Cracking Test

The following test was conducted in order to evaluate corrosion resistance to stress corrosion cracking of the heat transfer tube having inner and outer surfaces plated with nickel according to the present invention.

The heat transfer tube expanded in Experimental Example 1 was cut into a C-ring specimen. The C-ring specimen was screwed with a bolt to apply tensile stress onto the outer surface thereof, and was spread out with a bolt to apply tensile stress onto the inner surface thereof. The tensile stress was applied onto the C-ring specimen through a process disclosed in the thesis ASTM G38 [ASTM G3, "Practice for making and using C-ring stress corrosion test specimens", 2002] such that the tensile stress applied to the maximum stress region at the apexes of the inner and outer surfaces thereof was 150% of the yield stress of Alloy 600. Subsequently, the stress corrosion cracking test of the C-ring specimen was conducted using a nickel-made autoclave filled with a 40% NaOH solution at a temperature of 315° C. In this case, in order to accelerate the stress corrosion cracking, electric potential 200 mV higher than corrosion potential was applied to the C-ring specimen. After 60 days, in order to observe the occurrence of cracks, the C-ring specimen was taken out from the autoclave, cut in a direction perpendicular to its axis, and then observed by an optical microscope, and the results thereof are shown in FIG. 3.

Figure 3:
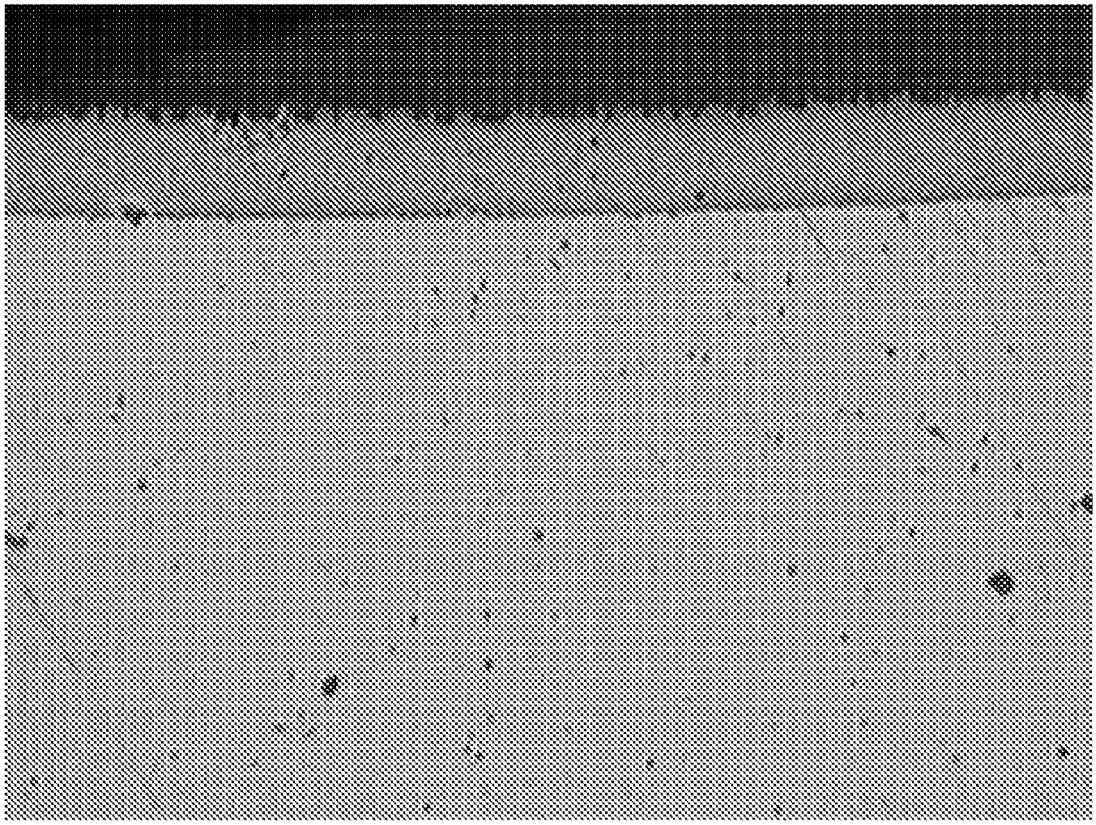
FIG. 3 is an optical micrograph showing a specimen of a nickel-plated heat transfer tube of the steam generator, which is expanded and then undergoes a stress corrosion test, according to an embodiment of the present invention.

As shown in FIG. 3, although the stress corrosion cracking test was conducted for a long time, the stress corrosion cracking of Alloy 600 was not observed at all. However, from FIG. 3, it can be seen that general corrosion occurred on the surface of the nickel plated layer when the stress corrosion cracking test was conducted for a long time in a state in which an electric potential of 200 mV was applied to the C-ring specimen in a strong basic solution.

Further, in order to evaluate the relative stress corrosion cracking properties of Alloy 600 and a nickel plated layer, a C-ring specimen plated with nickel only on the inner surface thereof was manufactured. Subsequently, the stress corrosion cracking test of the C-ring specimen was conducted for 7 days under the above conditions, and then whether or not cracks were formed was observed, and the results thereof are shown in FIG. 4.

Figure 4:
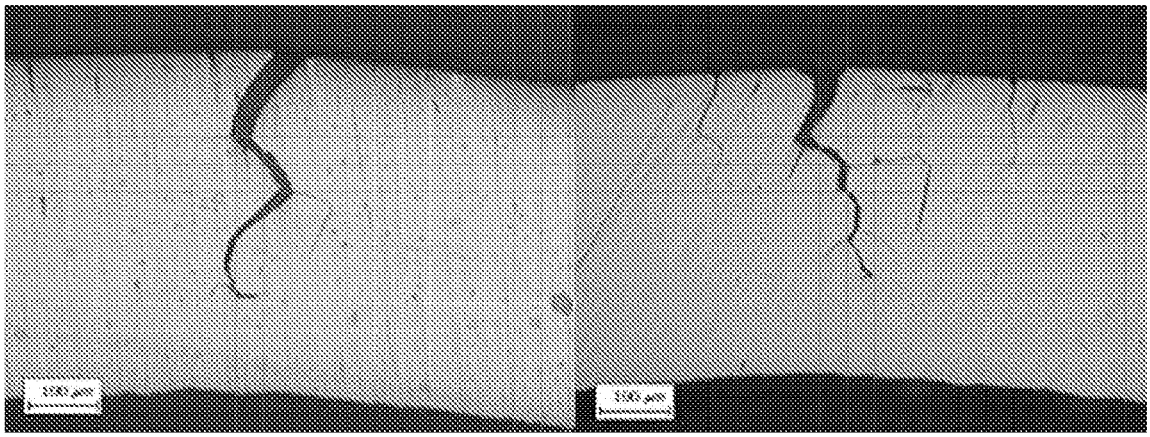
FIG. 4 is an optical micrograph showing a specimen of a nickel-plated heat transfer tube of the steam generator, only the inner portion of which is nickel-plated, and which undergoes a stress corrosion test, according to an embodiment of the present invention.

From FIG. 4, it can be seen that stress corrosion cracking occurred in Alloy 600, but stopped on the interface between the nickel plated layer and Alloy 600. That is, cracks were continuously formed along the direction of the thickness of a tube, and then the formation of the cracks stopped on the interface between the nickel plated layer and Alloy 600. Therefore, it can be seen that the nickel plated layer has excellent corrosion resistance to stress corrosion cracking compared to Alloy 600.

Experimental Example 3

Pitting Corrosion Test

The following test was conducted in order to evaluate the resistance to pitting corrosion of the heat transfer tube having inner and outer surfaces plated with nickel according to the present invention.

The nickel-plated heat transfer tube manufactured in Example 1 was cut before and after the expansion thereof to form C-ring specimens. Each of the C-ring specimens was immersed into 6 wt % of a $FeCl_2$ solution at room temperature for 12 hours, and then the surface of each of the C-ring specimens was observed using an optical microscope, and the results thereof are shown in FIGS. 5 and 6.

Figure 5:
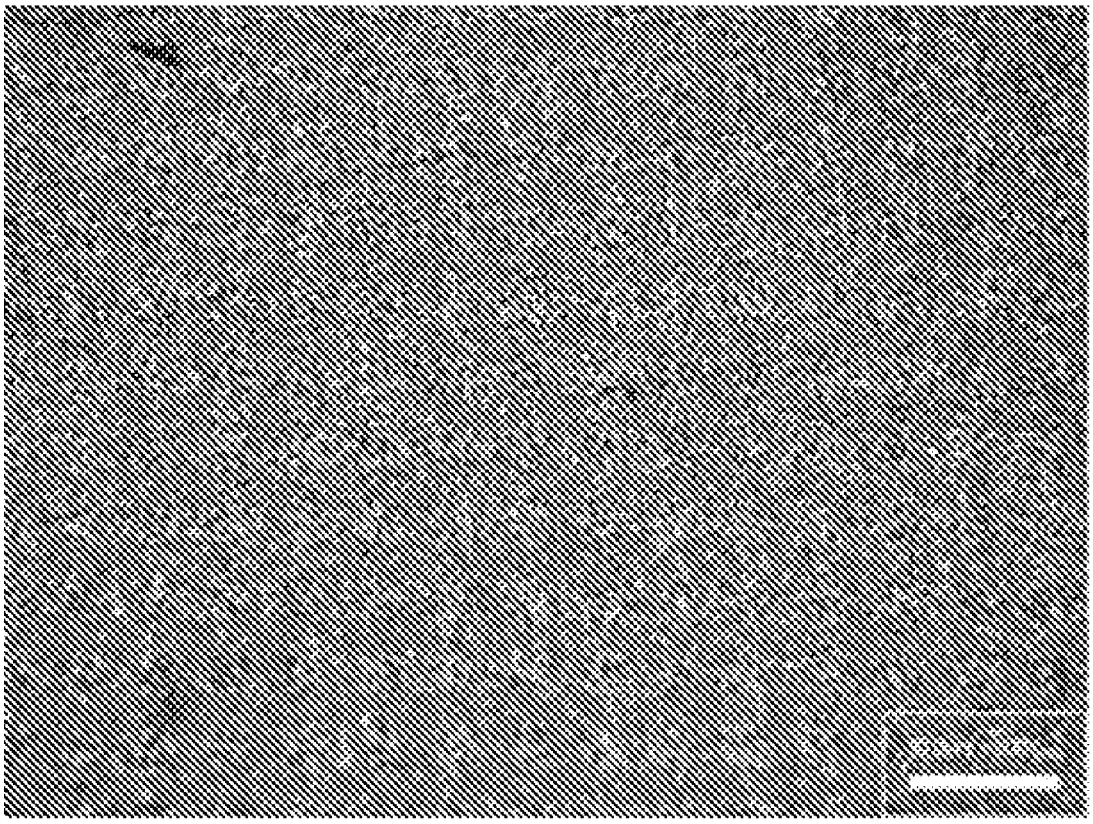
FIG. 5 is an optical micrograph showing the surface of a specimen of a nickel-plated heat transfer tube of the steam generator, which undergoes a pitting corrosion test prior to the expansion thereof, according to an embodiment of the present invention.
Figure 6:
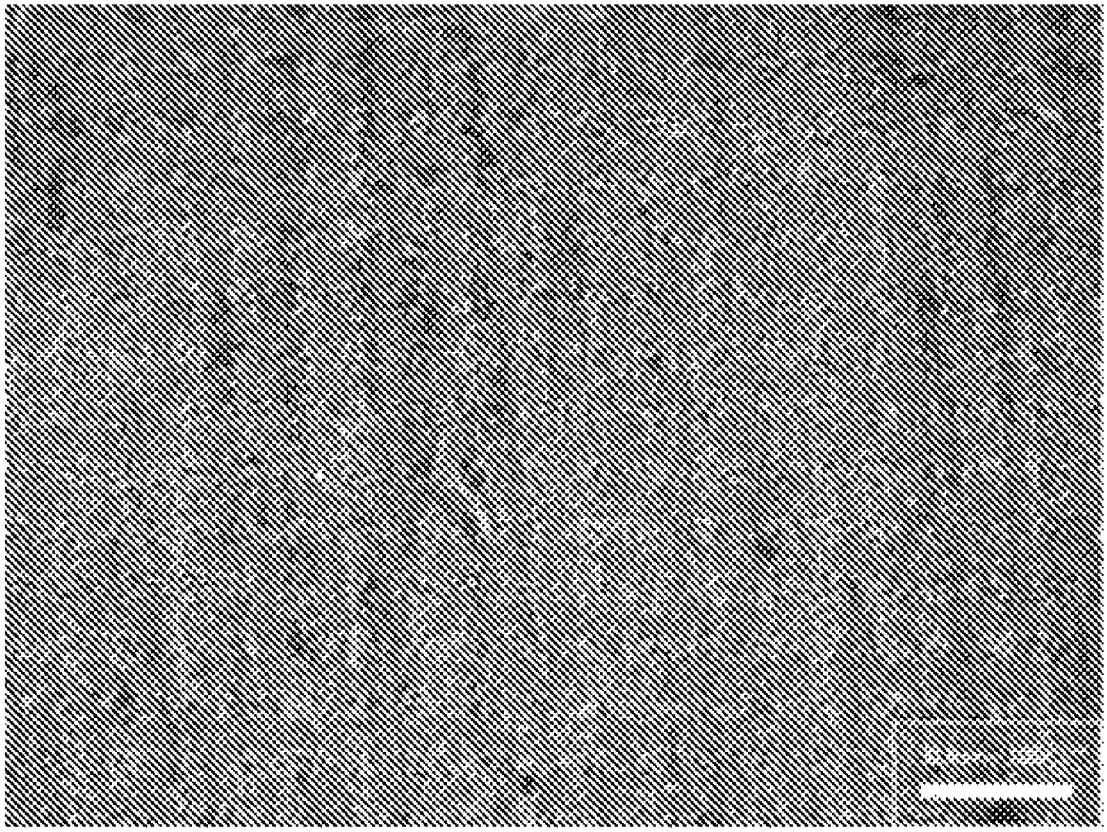
FIG. 6 is an optical micrograph showing the surface a specimen of a nickel-plated heat transfer tube of the steam generator, which is expanded and then undergoes a pitting corrosion test, according to an embodiment of the present invention.

FIG. 5 shows the nickel plated layer of the heat transfer tube before the expansion thereof, and FIG. 6 shows the nickel plated layer of the heat transfer tube after the expansion thereof.

From FIGS. 5 and 6, it was found that pitting corrosion did not occur in both cases.

Therefore, the nickel-plated heat transfer tube can be usefully used in a steam generator because a nickel plated layer is not separated from the nickel-plated heat transfer tube even after the expansion thereof and the pitting corrosion or stress corrosion cracking of a matrix can be prevented.

As described above, the heat transfer tube of the steam generator according to the present invention can prevent various types of corrosion damage, such as pitting corrosion, abrasion, stress corrosion cracking, lead-induced stress corrosion cracking and the like, occurring during the operation of the steam generator, and particularly, pitting corrosion or primary and secondary stress corrosion cracking, so that the life span of the steam generator is increased, maintenance costs are reduced, and the operation rate of a nuclear power plant is increased, with the result that the unit cost of the production of electric power can be decreased, thereby improving economic efficiency. Further, the heat transfer tube according to the present invention can be usefully used to prevent the corrosion damage of parts and equipment of nuclear, hydroelectric or thermoelectric power plants, of petrochemical plants, and also industrial and machine parts and equipment, and parts and equipment used in the defense industry.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of preventing corrosion degradation in a heat transfer tube of a steam generator comprising expanding the heat transfer tube after plating both an inner surface and an outer surface of the heat transfer tube with Ni—Fe—P or Ni—P—B.

2. The method according to claim 1, wherein the Ni—Fe—P or Ni—P—B plating is partially or entirely conducted on both the inner surface and the outer surface of the heat transfer tube.

3. The method according to claim 1, wherein the expanding of the heat transfer tube plated with Ni—Fe—P or Ni—P—B is performed by a mechanical expansion method, an explosion expansion method or a hydraulic expansion method.

4. The method according to claim 1, wherein the corrosion degradations are one or more selected from the group consisting of pitting corrosion, abrasion, stress corrosion cracking, and lead-induced stress corrosion cracking.

5. The method according to claim 1, wherein an expansion transition region or an expansion region of the heat transfer tube is plated with Ni—Fe—P or Ni—P—B before expanding the heat transfer tube.

6. The method according to claim 1, wherein an expansion transition region and an expansion region of the heat transfer tube are plated with Ni—Fe—P or Ni—P—B before expanding the heat transfer tube.

7. The method according to claim 1, wherein a plating thickness is 1~1000 μm.

8. The method according to claim 1, wherein the steam generator is used in a nuclear power plant, a hydroelectrical power plant, thermoelectric power plant, or petrochemical plant.

9. The method according to claim 1, wherein the steam generator is used in a nuclear power plant.

* * * * *